US008240496B2

(12) United States Patent
Kong et al.

(10) Patent No.: US 8,240,496 B2
(45) Date of Patent: Aug. 14, 2012

(54) COLLAPSIBLE CONTAINER AND HINGE USED FOR COLLAPSIBLE CONTAINER

(75) Inventors: Heqing Kong, Guangdong (CN); Shengqi Li, Guangdong (CN); Shufang Yang, Guangdong (CN)

(73) Assignee: China International Marine Containers (Group) Ltd., Shenzhen, Guangdong (CN)

( * ) Notice: Subject to any disclaimer, the term of this patent is extended or adjusted under 35 U.S.C. 154(b) by 276 days.

(21) Appl. No.: 12/745,844

(22) PCT Filed: Jul. 28, 2008

(86) PCT No.: PCT/CN2008/001384

§ 371 (c)(1), (2), (4) Date: Jun. 2, 2010

(87) PCT Pub. No.: WO2009/070956

PCT Pub. Date: Jun. 11, 2009

(65) Prior Publication Data

US 2010/0270298 A1 Oct. 28, 2010

(30) Foreign Application Priority Data

Dec. 3, 2007 (CN) ..... 2007 1 0197038

(51) Int. Cl.
*B65D 19/12* (2006.01)

(52) U.S. Cl. ..... 220/4.33; 220/6; 108/55.1

(58) Field of Classification Search ..... 220/4.33, 220/6, 1.5, 4.28; 108/55.1
See application file for complete search history.

(56) References Cited

U.S. PATENT DOCUMENTS

| | | | | |
|---|---|---|---|---|
| 4,638,744 | A | 1/1987 | Clive-Smith | |
| 5,644,992 | A * | 7/1997 | Clive-Smith | 108/55.1 |
| 7,827,655 | B2 * | 11/2010 | Yi | 16/261 |
| 2005/0081762 | A1 * | 4/2005 | Clive-Smith | 108/51.11 |
| 2008/0244864 | A1 * | 10/2008 | Yi | 16/221 |

FOREIGN PATENT DOCUMENTS

| | | | |
|---|---|---|---|
| CN | 1798897 | A | 7/2006 |
| CN | 1923082 | A | 3/2007 |
| DE | 3406461 | A1 | 8/1984 |
| GB | 2295381 | A | 5/1996 |
| WO | 2004106678 | A1 | 12/2004 |

* cited by examiner

*Primary Examiner* — Stephen Castellano
(74) *Attorney, Agent, or Firm* — The Webb Law Firm

(57) ABSTRACT

Disclosed is a collapsible container and a hinge used for the collapsible container. The hinge includes an inner hinge, an outer hinge, a first pivoting pin and a second pivoting pin movably and pivotally connected to the inner hinge and the outer hinge. The inner hinge and outer hinge are both provided with pivoting holes, respectively, and the first pivoting pin and the second pivoting pin are respectively inserted into the corresponding pivoting holes to pivotally connected or disconnect the inner hinge with the outer hinge. When one of the first pivoting pin and the second pivoting pin is pulled out, the outer hinge can overturn around the other pivoting pin hence to make the end wall overturn and fold towards inside or outside of the container body. When the first pivoting pin and the second pivoting pin are simultaneously located within the pivoting holes of the corresponding inner hinge and outer hinge, the end wall is fixed to the vertical state.

18 Claims, 7 Drawing Sheets

COLLAPSIBLE CONTAINER AND HINGE USED FOR COLLAPSIBLE CONTAINER

FIELD OF THE INVENTION

The invention relates to components of a large scale and rigid collapsible receptacle, and particularly relates to components used for a collapsible box, and especially relates to a bi-directional foldable hinge used for a collapsible box.

The present invention also relates to a collapsible container utilizing this bi-directional foldable hinge

BACKGROUND OF THE INVENTION

The platform container and the platform based container are more and more widely used in multimodal transport of freight due to the convenience of loading and unloading a freight and a large loading capacity, the structure of which mainly comprises a floor 1', a loading platform and end structures provided at two ends of the floor, which can be divided into two kinds of structure, i.e. fixed end structure and foldable end structure.

As illustrated in FIG. 1, it shows a currently used container which is collapsible (usually, referred to as a collapsible container for short), the end structure of which is merely limited to be unidirectional folded, namely, the end wall 2' merely being folded in one direction (folded towards the direction of the floor 1' of the container), and not being folded in a direction opposite to the one direction. This folding is realized by the existing hinge used for a collapsible container, and the main purpose of this unidirectional foldable end structure is to decrease the cost of stocking and transporting an empty container.

As illustrated in FIG. 2, a currently common collapsible container hinge 3' (FIG. 1) comprises: an outer hinge 30' comprised of two parallel plates, an inner hinge 31' provided within the outer hinge 30' and connected to the outer hinge 30' by means of a pivoting pin 33', a hinge top plate 32' provided on top of the outer hinge 30', and a conical pin 34' for locking the inner hinge 31' and the outer hinge 30'; a notch 320' is provided on the hinge top plate 32' to contain the inner hinge 31', locking holes 301' and 311' are correspondingly provided on the outer hinge 30' and the inner hinge 31'. When the end wall is required to be set upright, the conical pin 34' goes through the locking holes 301' and 311', thereby locking the inner hinge 31' and the outer hinge 30'; when the end wall is required to be folded toward inside of the container body, the conical pin 34' is pulled out of the locking holes 301' and 311' and the inner hinge 31' is folded towards inside of the container body around the pivoting pin 33'.

However, during the container transporting, it is usually to transport some special products, such as motor vehicles etc, and for these products, a ramp is often need to load and unload these products. The present existing solutions is to use a removed end wall of the collapsible container as a ramp, namely, the end wall is removed from the floor at first and is placed horizontally in a direction opposite to its initial direction, then one end of the end wall is placed on the floor, and the other end of the end wall is placed on the ground, and the end wall is needed to orient and fix. It is necessary to use auxiliary equipments such as a crane or a forklift to carry out the above method, which is neither safe nor convenient, and cause the high-cost of freight load and time-consuming.

SUMMARY OF THE INVENTION

In view of the deficiencies of prior art, the main objection of the present invention is to provide a hinge used for a collapsible container which can be bi-directional folded.

Another objection of the present invention is to provide a collapsible container, an end wall of which can be safely folded in two-direction. When the collapsible container employs the bi-directional foldable hinge, the end wall can be used as a ramp when folded towards outside of the container body.

In order to achieve the above objection, the present invention provides a hinge used for a collapsible container comprising: an inner hinge comprising two inner hinge plates parallel to each other, the two inner hinge plates being aligned with each other separately to be fixedly connected to corresponding bottom corner fitting and end transverse member of the collapsible container, the two inner hinge plates being provided with two pivoting holes respectively, the locations of which correspond to each other, and hoisting holes used for craning being provided at the upper middle positions of the two inner hinge plates, respectively; an outer hinge disposed outside of the inner hinge and fixedly connected to the lower end of corresponding corner post of an end wall of the collapsible container, the outer hinge comprising two outer hinge plates parallel to each other, and the two outer hinge plates being provided with two pivoting holes which are corresponding to the pivoting holes located on the two inner hinge plates, respectively, limiting step in a shape of step being provided on the two outer hinge plates where close to corresponding bottom corner fitting thereof, which are matched up with the bottom corner fitting for limiting and fixing the end wall in position; a first pivoting pin being inserted into or disengaged from the pivoting holes of the inner and outer hinge plates corresponding to each other to enable the inner and outer hinges to be pivotally connected or disconnected; a second pivoting pin which is configured to run parallel to the first pivoting pin and operate in conjunction with the first pivoting pin, the second pivoting pin being disengaged from or inserted into the pivoting holes of the outer and inner hinge plates corresponding to each other to enable the inner and outer hinges to be pivotally connected or disconnected; wherein when one of the first and second pivoting pins is pulled out, the outer hinge is overturned around the other pivoting pin to make the end wall overturn and fold towards inside or outside of the container body; when the first and second pivoting pins are simultaneously located in the pivoting holes of the inner and outer hinges corresponding to each other, the end wall of the collapsible container is fixed to the vertical state.

In the hinge used for a collapsible container, wherein in order to ensure that the collapsible container employing the hinge of the present invention also can meet the requirement of hoisting and stacking of a general purpose collapsible container, an inner hinge top plate is perpendicularly provided on top of the two inner hinge plates parallel to each other, and a U-shaped notch is disposed in the inner hinge top plate, which is used for craning the collapsible container. The inner hinge can be a casting or a welded part integrally formed by the two inner hinge plates and the inner hinge top plate.

In the hinge used for a collapsible container, wherein an outer hinge top plate is perpendicularly provided on top of the two outer hinge plates parallel to each other, and protrusions are provided on top ends of the two outer hinge plate which are connected to the corner post of the end wall, the protrusions being fittingly connected with the corner post of the end wall; the outer hinge can be a casting or a welded part integrally formed by the two outer hinge plates and the outer hinge top plate.

In the hinge used for a collapsible container, wherein the inner hinge plates are L-shaped plates, and two pivoting holes located on the inner hinge plates are formed on two extended ends of the inner hinge plate respectively; the outer hinge plates are L-shaped plates, and two pivoting holes located on the outer hinge plates are formed on two extended ends of the outer hinge plate respectively.

In order to achieve the above objection, the present invention also provides a collapsible container employing the above hinge structure, which comprises a floor, an end wall, a hinge pivotally connected between the end wall and the floor, a corner fittings installed on the floor and the end wall; the hinge comprises: an inner hinge comprising two inner hinge plates parallel to each other, the bottom portion of the two inner hinge plates being fixedly connected to the bottom corner fittings and the end transverse member of the collapsible container, the two inner hinge plates being provided with two pivoting holes respectively, and hoisting holes used for craning being provided at the upper middle positions of the two inner hinge plates, respectively; an outer hinge disposed outside of the inner hinge and fixedly connected to a lower end of a corner post of the end wall of the collapsible container, the outer hinge comprising two outer hinge plates parallel to each other, the two outer hinge plates being provided with two pivoting holes corresponding to the pivoting holes located on the two inner hinge plates, respectively; limiting step in a shape of step being provided at the two outer hinge plates where close to the bottom corner fittings, which is used to limit and fix the end wall in position; a first pivoting pin being inserted into or disengaged from the pivoting holes of the inner and outer hinge plates corresponding to each other to enable the inner and outer hinges to be pivotally connected or disconnected; and a second pivoting pin which is configured to run parallel to the first pivoting pin and operate in conjunction with the first pivoting pin, the second pivoting pin being disengaged from or inserted into the pivoting holes of the inner and outer hinge plates corresponding to each other to enable the inner and outer hinges to be disengaged or pivotally connected; wherein when one of the first and second pivoting pins is pulled out, the outer hinge is overturned around the other pivoting pin to make the end wall overturn and fold towards inside or outside of the container body; when the first and second pivoting pins are simultaneously located in the pivoting holes of the inner and outer hinges corresponding to each other, the end wall is fixed to the vertical state.

In the hinge used for a collapsible container, wherein in order to ensure that the collapsible container can meet the requirement of hoisting and stacking of a general purpose collapsible container, an inner hinge top plate is perpendicularly provided on top of the two inner hinge plates parallel to each other, a U-shaped notch for craning the collapsible container is provided in the inner hinge top plate; the inner hinge can be a casting or a welded part integrally formed by the two inner hinge plates and the inner hinge top plate.

In the hinge used for a collapsible container, wherein an outer hinge top plate is perpendicularly provided on top of the two outer hinge plates parallel to each other, and protrusions are provided on top ends of the two outer hinge top plates which are connected to the corner post of the end wall, the protrusions being fittingly connected with the corner post of the end wall. The outer hinge can be a casting or a welded part integrally formed by the two outer hinge plates and the outer hinge top plate.

In the hinge used for a collapsible container, wherein the inner hinge plates are L-shaped plates, and two pivoting holes located on the inner hinge plates are formed onto two extended ends of the inner hinge plate respectively; the outer hinge plates are L-shaped plates, and two pivoting holes located on the outer hinge plates are formed onto two extended ends of the outer hinge plate respectively.

The present invention develops a bi-directional foldable hinge structure, which can be bi-directional folded without removing the end wall and without using a crane or a forklift, and after the end wall is folded towards outside of the container body, the end wall can be used as a ramp, thereby providing a convenient and fast approach for loading special products such as motor vehicles. On the other hand, the collapsible container of the present invention remains the feature that the existing hinge can be folded towards inside of the container body and meets the size requirement of standard collapsible container, thereby satisfying hoisting and stocking requirements according to ISO standard at the same time. Therefore, as for some special products such as motor vehicles etc, they can be directly driven onto or off the floor platform of the container through the ramp which is formed by the end wall folding towards outside of the container body, without the help of a hoisting apparatus, thereby the time of loading a cargo is shortened and the cost of loading a cargo is decreased.

REFERENCE NUMERALS ARE AS FOLLOWS

| Prior art: | | |
|---|---|---|
| 1' | floor | 2' end wall |
| 3' | hinge | |
| 30' | outer hinge | |
| 301' | locking hole | |

-continued

| | | |
|---|---|---|
| 31' | inner hinge | |
| 311' | locking hole | |
| 32' | hinge top plate | |
| 320' | notch | |
| 33' | pivoting pin | 34' conical pin |

The present invention:

| | | |
|---|---|---|
| 1 | floor | 2 end wall 4 bottom corner fittings |
| 3 | hinge | |
| 30 | outer hinge | |
| 301 | first outer hinge plate | |
| 3011, 3012 | first and second pivoting holes of the first outer hinge plate | |
| 3013, 3014 | limiting step of the outer hinge plate | |
| 302 | second outer hinge plate | |
| 3021, 3022 | first and second pivoting holes of the second outer hinge plate | |
| 303 | outer hinge top plate | |
| 31 | inner hinge | |
| 311 | the first inner hinge plate | |
| 3111, 3112 | first and second pivoting holes of the first inner hinge plate | |
| 3113 | hoisting side hole | |
| 312 | second outer hinge plate | |
| 3121, 3122 | first and second pivoting holes of the second inner hinge plate | |
| 3123 | hoisting side hole | |
| 313 | inner hinge top plate | |
| 3131 | U-shaped notch of the inner hinge top plate | |
| 33, 34 | first and second pivoting pins | |

DETAILED DESCRIPTION OF THE PREFERRED EMBODIMENTS

The technical solution and other advantageous effects of the present invention will be more apparent from the following detailed description of the particular embodiment of the present invention taken in conjunction with the accompanying drawings.

The hinge of the present invention is pivotally connected between the floor and the corner post of the end wall, so as to realize the function of folding between the vertical state and the lay-down state relative to the floor like the freight container hinge of prior art, at the same time to realize the function that the end wall is overturned and folded towards outside of the container body. The characteristic feature of the present invention is in that structure of the hinge used for a collapsible container, and the structure of other components of the collapsible container will be omitted herein.

Figure 1:
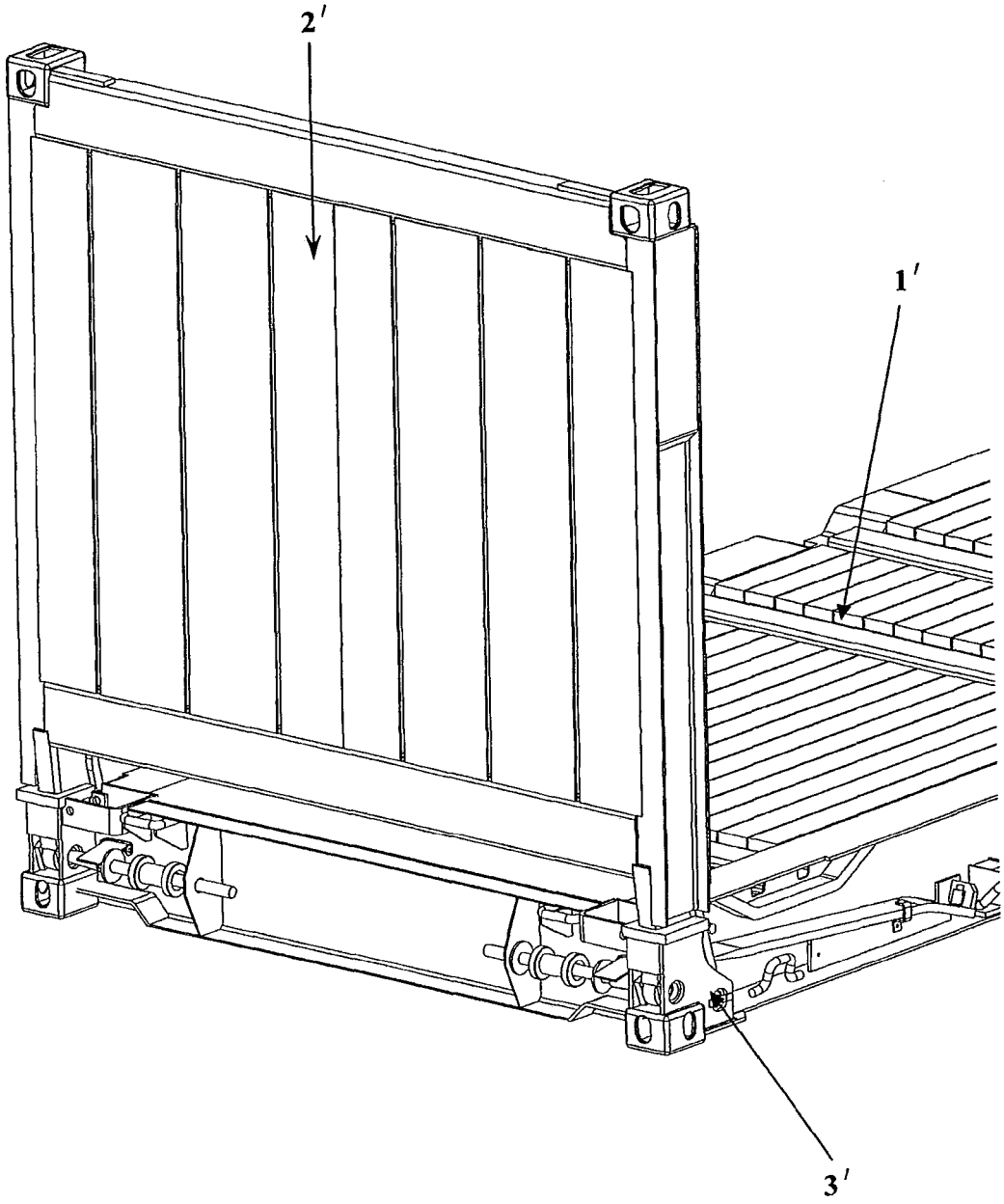
FIG. 1 is a structural schematic diagram of a general purpose collapsible container of prior art.
Figure 2:
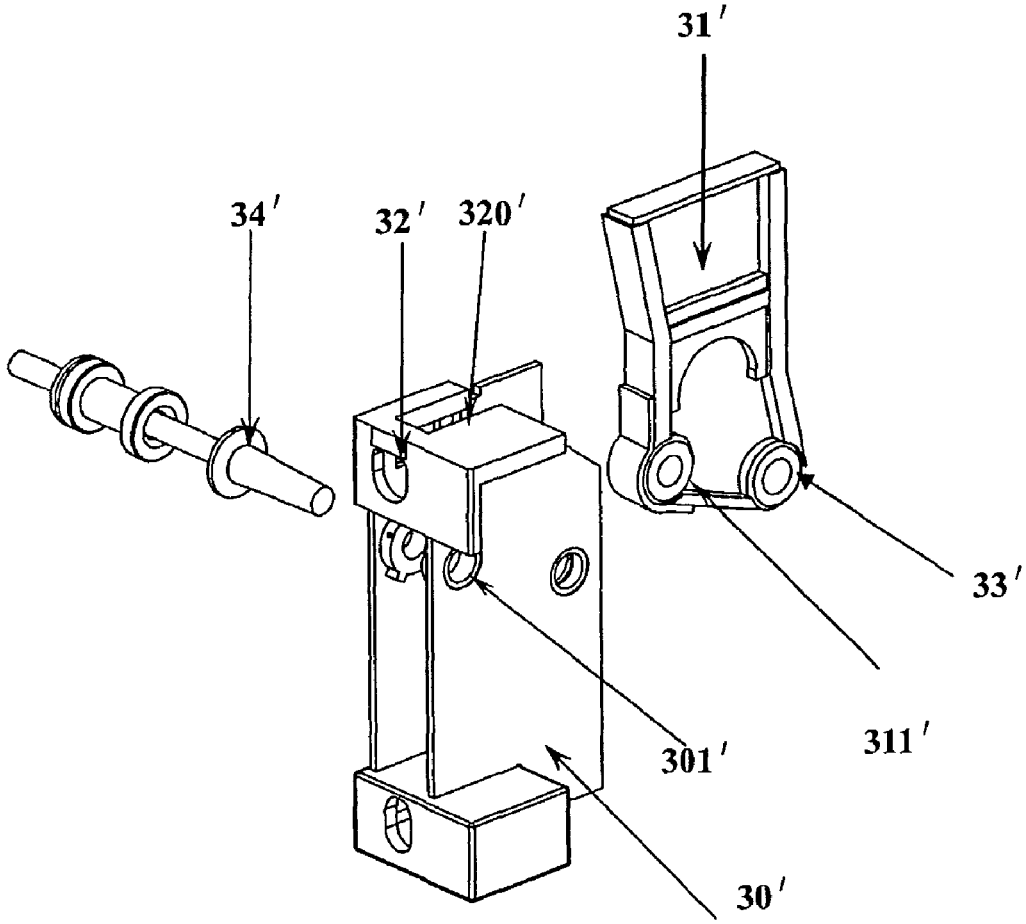
FIG. 2 is a structural schematic diagram of a hinge used for a general purpose collapsible container of prior art.
Figure 3:
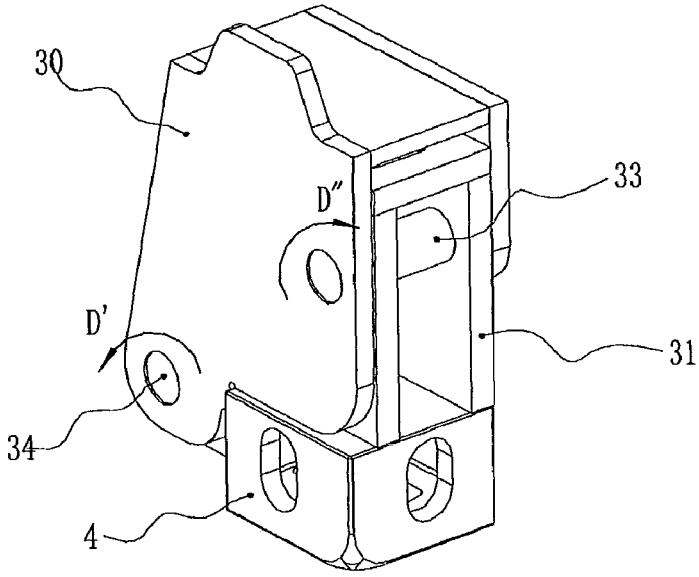
FIG. 3 is a schematic diagram of a whole structure of a hinge used for a collapsible container of the present invention.

FIG. 3 is a whole schematic diagram of the hinge 3. As illustrated in FIG. 3, the hinge 3 for a collapsible container of the present invention comprises an inner hinge 31, an outer hinge 30, a first pivoting pin 33 and a second pivoting pin 34. The inner hinge 31 and the outer hinge 30 are movably connected by means of the first pivoting pin 33 and the second pivoting pin 34.

Figure 4:
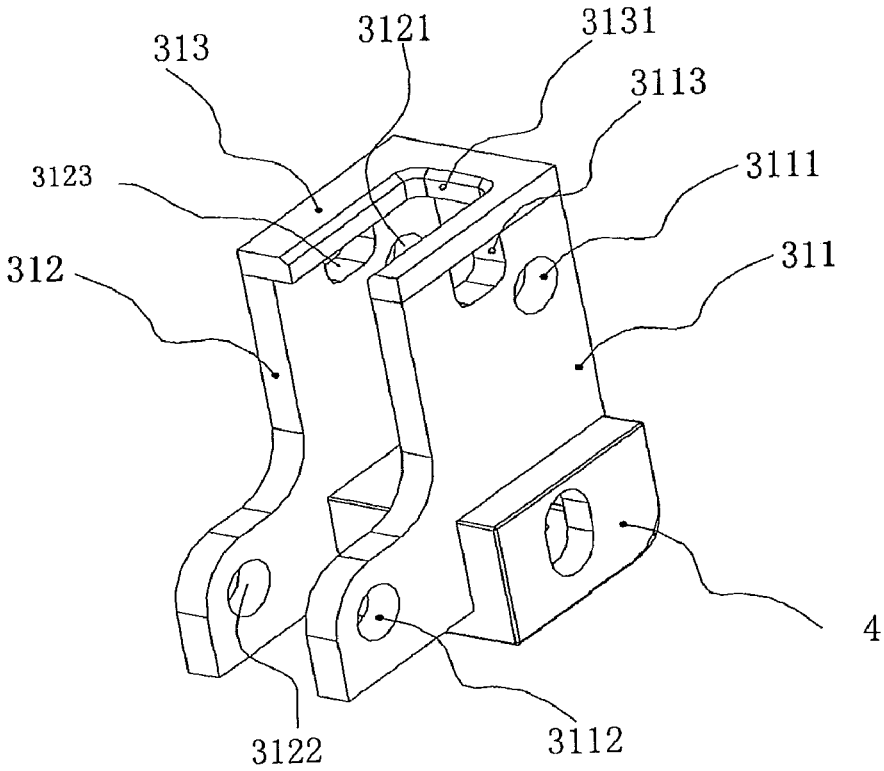
FIG. 4 is a structural schematic diagram of an inner hinge of a hinge used for the collapsible container of the present invention.

FIG. 4 is a structural schematic diagram of the inner hinge 31. As illustrated in FIG. 4, the inner hinge 31 comprises a first inner hinge plate 311, a second inner hinge plate 312 and an inner hinge top plate 313. Both the first inner hinge plate 311 and the second inner hinge plate 312 can be L-shaped plates, located on the outside and inside of the container body respectively, and provided parallel to each other. The inner hinge top plate 313 is perpendicularly provided on top of the first inner hinge plate 311 and the second inner hinge plate 312. The inner hinge top plate 313 is provided with a U-shaped notch 3131 which plays a role similar to that of a top hole of top corner fitting of the container and can be used as the top hole of the top corner fitting of the container. In addition, hoisting side holes 3113, 3123 corresponding to the top corner fitting of the container are also provided at the edges of the first inner hinge plate 311 and the second inner hinge plate 312 where close to the inner hinge top plate 313, respectively. Furthermore, a first pivoting hole 3111 and a second pivoting hole 3112 are provided on two extended ends of the first inner hinge plate 311, and a first pivoting hole 3121 and a second pivoting hole 3122 are provided on two extended ends of the second inner hinge plate 312, which are coaxial with a first pivoting hole 3111 and a second pivoting hole 3112 of the first inner hinge plate respectively, so as to be used to connect with the outer hinge 30.

In the above-described structure of the inner hinge, from the point of theory, if the two hoisting side holes 3113, 3123 are provided on the two inner hinge plates respectively, the inner hinge top plate 313 may not be provided separately, and then the space between the two inner hinge plates is used as the top hole of the top corner fitting, so as to ensure that the container can be hoisted after the end wall is folded towards inside of the container body.

Figure 5:
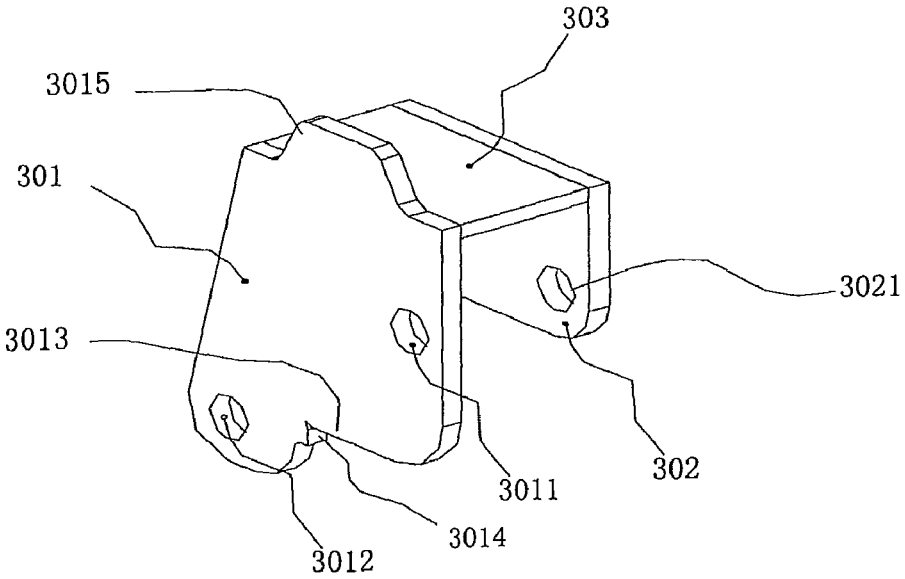
FIG. 5 is a structural schematic diagram of an outer hinge of a hinge used for the collapsible container of the present invention.
Figure 7:
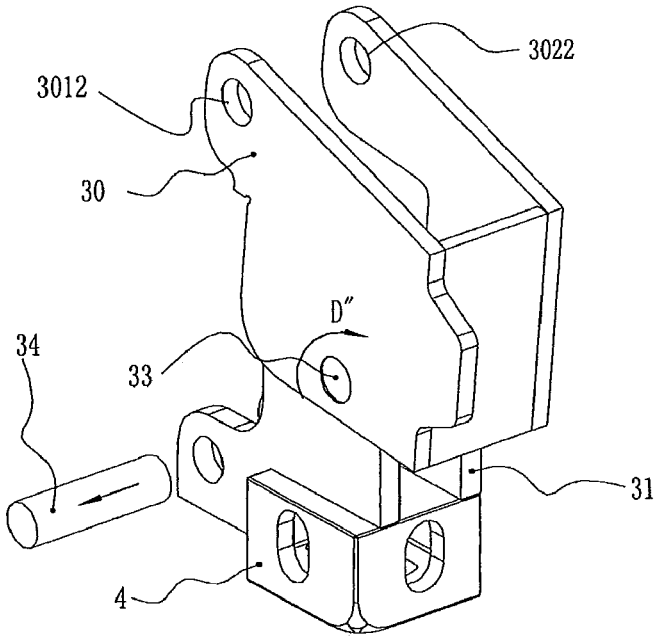
FIG. 7 is a structural schematic diagram of the outer hinge of a hinge used for the collapsible container of the present invention when the outer hinge is overturned towards outside of the container body.

FIG. 5 is a structural schematic diagram of the outer hinge 30. As illustrated in FIG. 5, the outer hinge 30 comprises a first outer hinge plate 301, a second outer hinge plate 302 and an outer hinge top plate 303. Both the first outer hinge plate 301 and the second outer hinge plate 302 can be L-shaped plates, and located on the outside and inside of the container body respectively, and configured to be parallel to each other. The outer hinge top plate 303 is perpendicularly provided on top of the first outer hinge plate 301 and the second outer hinge plate 302. A first pivoting hole 3011 which is coaxial with the first pivoting holes 3111, 3121 of the first and second inner hinge plates, and a second pivoting hole 3012 which is coaxial with the second pivoting holes 3112, 3122 of the first and second inner hinge plates are provided at two extended ends of the first outer hinge plate 301; and a first pivoting hole 3021 which is coaxial with the first pivoting holes 3111, 3121 of the first and second inner hinge plates, and a second pivoting hole 3022 which is coaxial with the second pivoting holes 3112, 3122 of the first and second inner hinge plates are provided at two extended ends of the second outer hinge plate 302 (as illustrated in FIG. 7). The pivoting hole 3011 is coaxial with the pivoting hole 3021, and the pivoting hole 3012 is coaxial with the pivoting hole 3022.

In the above-described structure of the outer hinge, from the point of theory, if the two outer hinge plates are connected to the corner post of the end wall directly, the outer hinge top plate 303 may not be provided separately. Whereas, a protrusion portion 3015 provided on top end of the outer hinge plate 301 as shown in FIG. 5 is to allow the outer hinge plate 301 in better connection with the corner post of the end wall, since the corner post of the end wall is provided with a notch 21 to match up and connect with the protrusion portion 3015 (as illustrated in FIG. 9).

Figure 6:
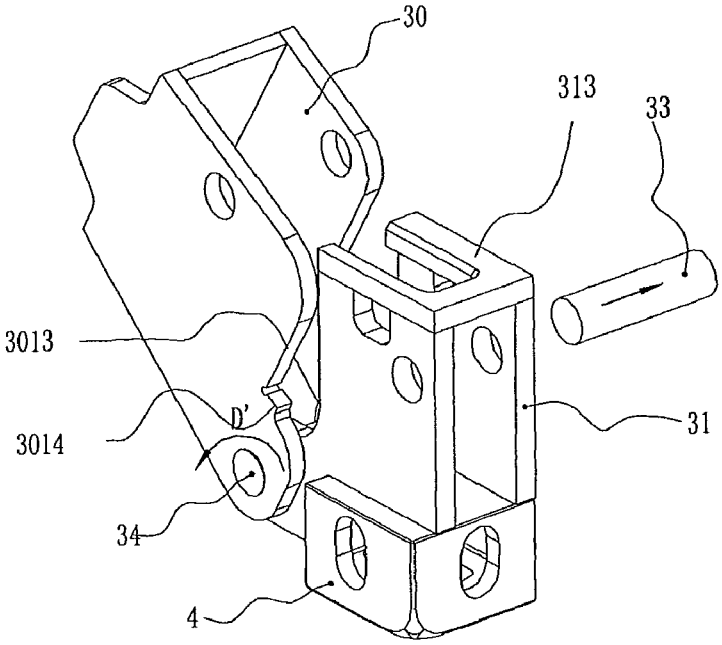
FIG. 6 is a structural schematic diagram of the outer hinge of a hinge used for the collapsible container of the present invention when the outer hinge is overturned towards inside of the container body.

FIGS. 3, 6 and 7 show the connection of the inner and outer hinges. The outer hinge 30 is disposed outside of the inner hinge 31; the first pivoting pin 33 is inserted into the first pivoting hole 3011 of the first outer hinge plate 301, the first pivoting holes 3111, 3121 of the first and second inner hinge plates 311, 312, and the first pivoting hole 3021 of the second outer hinge plate 302, respectively; while the second pivoting pin 34 is inserted into the second pivoting hole 3012 of the first outer hinge plate 301, the second pivoting holes 3112, 3122 of the first and second inner hinge plates 311, 312, and the second pivoting hole 3022 of the second outer hinge plate 302, respectively (as illustrated in FIG. 7), thereby the inner and outer hinges are pivotally connected.

Figure 9:
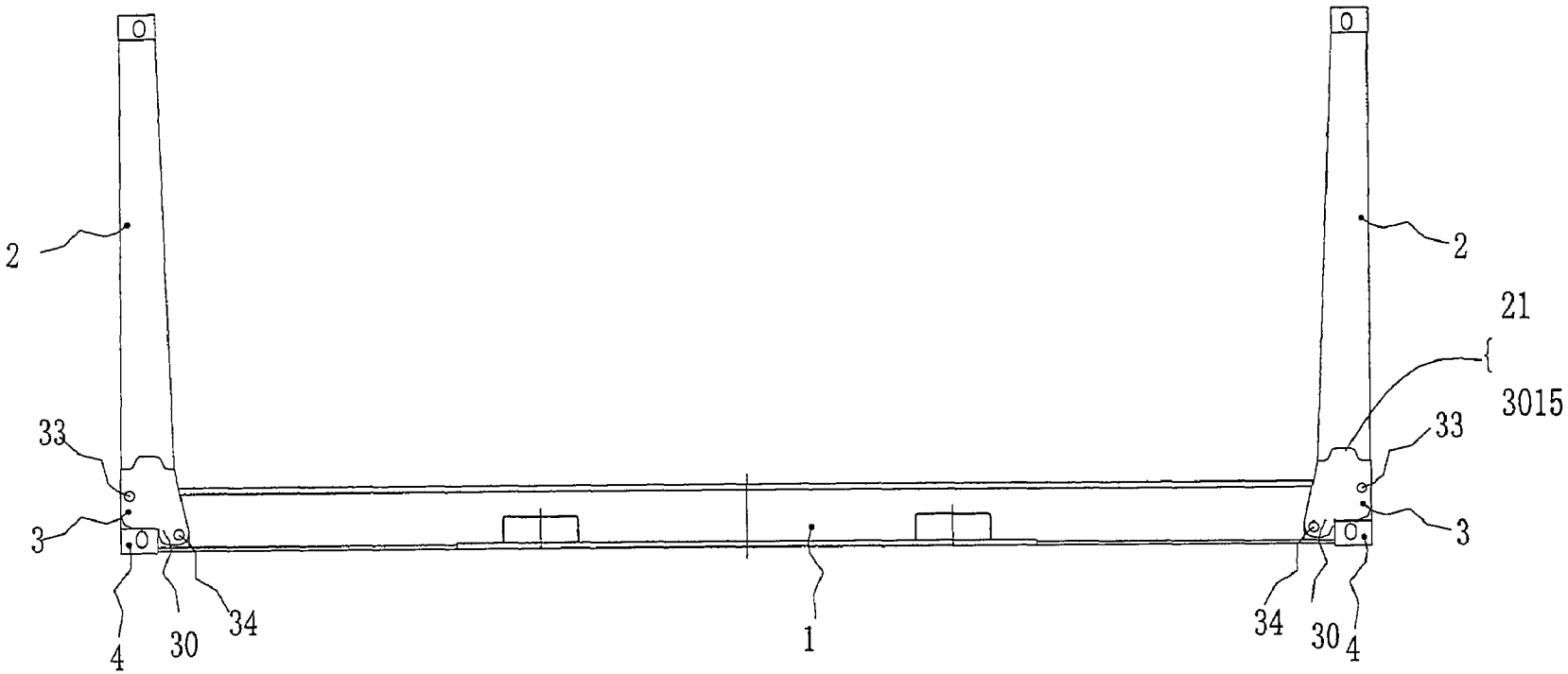
FIG. 9 is a schematic diagram showing the end walls of a collapsible container employing the hinge used for the collapsible container of the present invention in a vertical state.
Figure 10:
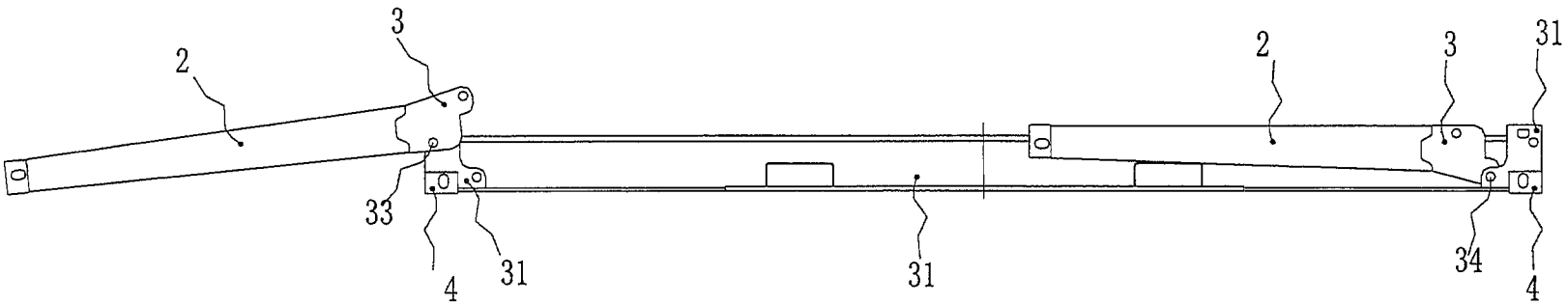
FIG. 10 is a schematic diagram showing that the end walls of a collapsible container employing the hinge used for a collapsible container of the present invention overturn towards two sides.

Referring to FIGS. 9 and 10, in the present embodiment, the bottom portion of the inner hinge 31 is fixedly connected to the top of the bottom corner fitting 4 and the end transverse member (not shown in the figures), and the outer hinge 30 is fixedly connected to the lower end of the end corner post (not shown in the figures) of the end wall 2 of the collapsible container.

As illustrated in FIGS. 6, 7, 10 again, when the first pivoting pin 33 is in the state of being pulled out, the end wall 2 can be overturned towards inside of the collapsible container around the second pivoting pin 34, so that the end wall 2 can be overlaid on the loading platform of floor 1; when the second pivoting pin 34 is in the state of being pulled out, the end wall 2 can be overturned towards outside of the collapsible container around the first pivoting pin 33, thereby enable the end wall 2 to use as a ramp for loading and unloading freight.

The operation process of the hinge of the present invention is showed as in FIGS. 6-10:

As illustrated in FIG. 6, when the first pivoting pin 33 is pulled out, the outer hinge 30 is overturned around the second pivoting pin 34 in the direction of D', which further make the end wall 2 of the collapsible container to fold on the loading platform of the floor 1, thereby the size of the empty container is reduced, and the cost of stocking and transporting the empty container is decreased.

As illustrated in FIG. 7, when the second pivoting pin 34 is pulled out, the outer hinge 30 is overturned around the first pivoting pin 33 in the direction of D", which further make the end wall 2 of the collapsible container to overturn towards outside of the loading platform of the floor, so as to form an inclined ramp for facilitating to load and unload a cargo. Therefore, as for some special products, for example, motor vehicles, can be directly driven onto the floor platform of the container through the ramp without the help of a crane apparatus, thereby the time for loading a cargo is shortened and the cost of transport is decreased.

Figure 8:
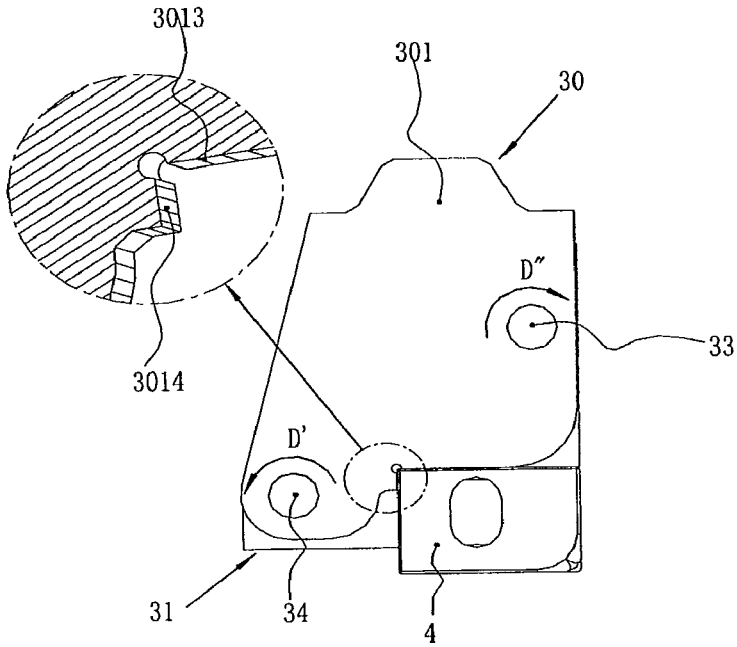
FIG. 8 is a structural schematic diagram of limiting step of an outer hinge plate of the hinge used for the collapsible container of the present invention.

Furthermore, as illustrated in FIG. 8, limiting step 3013, 3014 are provided at the first outer hinge plate 301 of the outer hinge 30 where close to the bottom corner fitting 4. When the second pivoting pin 34 is pulled out and the end wall 2 as a ramp is overturned upwardly around the first pivoting pin 33 and overturned to the vertical position, the limiting step 3014 located in vertical plane can limit the end wall 2 from continuing to overturn around the first pivoting pin 33 in the overturning direction to deviate from the vertical position, so as to limit the end wall 2 to the vertical position. At this time, the second pivoting pin 34 can be conveniently and safely inserted, in order to fix the end wall 2 to the vertical position; when the first pivoting pin 33 is pulled out and the end wall 2 overlaid on the platform of the floor 1 is overturned upwardly to the vertical position around the second pivoting pin 34, the limiting step 3013 located in horizontal plane can limit the end wall 2 from continuing to deviate from the vertical position around the first pivoting pin 33 in the overturn direction, so as to limit the end wall 2 to the vertical position. At this time, the first pivoting pin 33 can be conveniently and safely inserted, so that the end wall 2 is fixed to the vertical position, thereby the function required by the general collapsible container is achieved.

Similarly, the second outer hinge plate 302 of the outer hinge 30 is provided with limiting step correspondingly (not shown in the figures), the operation principle of which is identical with that of the limiting step of the first outer hinge plate 301, therefore detained description thereof will be omitted herein.

It can be understood from the technical knowledge that the present invention can be carried out by other embodiments without departing from the substantial spirit or essential feature thereof. Therefore, the above disclosed embodiment is merely illustrative explanation and not exclusive in all aspects. All modifications falling within the scope of the present invention or that equal to the scope of the present invention are included in the present invention.

The invention claimed is:

1. A collapsible container, comprising a floor, an end wall, a hinge pivotally connected between the end wall and the floor, a corner fitting installed on the floor and the end wall, wherein the hinge comprises:

an inner hinge comprising two inner hinge plates parallel to each other, the bottom portions of which are fixedly connected to the bottom corner fitting and the end transverse member of the collapsible container, the two inner hinge plates being provided with two pivoting holes respectively, and hoisting holes used for craning being provided at upper middle positions of the two inner hinge plates, respectively;

an outer hinge being disposed outside of the inner hinge and fixedly connected to a lower end of a corner post of the end wall of the collapsible container, the outer hinge comprising two outer hinge plates parallel to each other, which are provided with two pivoting holes corresponding to the pivoting holes located on the two inner hinge plates, respectively;

a first pivoting pin which is inserted into or disengaged from the pivoting holes of the inner and outer hinge plates corresponding so as to each other to enable the inner and outer hinges to be pivotally connected or disconnected; and a second pivoting pin which is configured to run parallel to and operate in conjunction with the first pivoting pin, the second pivoting pin being disengaged from or inserted into the pivoting holes of the inner and outer hinge plates corresponding to each other so as to enable the inner and outer hinges to be disengaged or pivotally connected;

wherein when one of the first and second pivoting pins is pulled out, the outer hinge can be overturned around the other pivoting pin to make the end wall overturn and fold towards inside or outside of a container body; when the first and second pivoting pins are simultaneously located in the pivoting holes of the inner and outer hinges corresponding to each other, the end wall is fixed to a vertical state.

2. The collapsible container according to claim 1, wherein limiting steps are provided at outside of the two outer hinge plates where close to the bottom corner fitting, for limiting the end wall to the vertical state when the outer hinge is overturned around the first pivoting pin or the second pivoting pin.

3. The collapsible container according to claim 1, wherein the inner hinge plates are L-shaped plates, and the two pivoting holes located on the inner hinge plates are formed on two extended ends of the inner hinge plate respectively; the outer hinge plates are L-shaped plates, and the two pivoting holes located on the outer hinge plates are formed on two extended ends of the outer hinge plate respectively.

4. The collapsible container according to claim 2, wherein the inner hinge plates are L-shaped plates, and the two pivoting holes located on the inner hinge plates are formed on two extended ends of the inner hinge plate respectively; the outer hinge plates are L-shaped plates, and the two pivoting holes located on the outer hinge plates are formed on two extended ends of the outer hinge plate respectively.

5. The collapsible container according to claim 1, wherein an inner hinge top plate perpendicular to the inner hinge plates is provided on top of the two inner hinge plates parallel to each other, and a U-shaped notch for craning the collapsible container is provided in the inner hinge top plate.

6. The collapsible container according to claim 2, wherein an inner hinge top plate perpendicular to the inner hinge plates is provided on top of the two inner hinge plates parallel to each other, and a U-shaped notch for craning the collapsible container is provided in the inner hinge top plate.

7. The collapsible container according to claim 5, wherein the inner hinge is a casting or a welded part integrally formed by the two inner hinge plates and the inner hinge top plate.

8. The collapsible container according to claim 6, wherein the inner hinge is a casting or a welded part integrally formed by the two inner hinge plates and the inner hinge top plate.

9. The collapsible container according to claim 1, wherein an outer hinge top plate is perpendicularly provided on top of the two outer hinge plates parallel to each other, and protrusions being fittingly connected with the corner post of the end wall are provided on top ends of the two outer hinge plates connected to the corner post of the end wall.

10. The collapsible container according to claim 2, wherein an outer hinge top plate is perpendicularly provided on top of the two outer hinge plates parallel to each other, and protrusions being fittingly connected with the corner post of the end wall are provided on top ends of the two outer hinge plates connected to the corner post of the end wall.

11. The collapsible container according to claim 9, wherein the outer hinge is a casting or a welded part integrally formed by the two outer hinge plates and the outer hinge top plate.

12. The collapsible container according to claim 10, wherein the outer hinge is a casting or a welded part integrally formed by the two outer hinge plates and the outer hinge top plate.

13. A hinge used for a collapsible container, comprising:

an inner hinge comprising two inner hinge plates parallel to each other, which are aligned and separated with each other, and fixedly connected to a corresponding bottom corner fitting and an end transverse member of the collapsible container, the two inner hinge plates being provided with two pivoting holes respectively, the locations of which correspond to each other, and hoisting holes used for craning being provided at upper middle positions of the two inner hinge plates, respectively;

an outer hinge being disposed outside of the inner hinge and fixedly connected to a lower end of corresponding corner post of an end wall of the collapsible container, the outer hinge comprising two outer hinge plates parallel to each other, which are provided with two pivoting holes corresponding to the pivoting holes located on the two inner hinge plates, respectively, limiting steps which are matched with the bottom corner fitting for limiting position being provided on the two outer hinge plates where close to the corresponding bottom corner fitting thereof, so as to limit and fix the end wall in position;

a first pivoting pin which is inserted into or disengaged from the pivoting holes of the outer and inner hinge plates corresponding to each other so as to enable the inner and outer hinges to be pivotally connected or disconnected; and a second pivoting pin which is configured to run parallel to and operate in conjunction with the first pivoting pin, the second pivoting pin being disengaged from or inserted into the pivoting holes of the inner and outer hinge plates corresponding to each other so as to enable the inner and outer hinges to be disconnected or pivotally connected;

wherein when one of the first and second pivoting pins is pulled out, the outer hinge can be overturned around the other pivoting pin to make the end wall overturn and fold towards inside or outside of a container body; when the first and second pivoting pins are simultaneously located in the pivoting holes of the inner and outer hinges corresponding to each other, the end wall of the collapsible container is fixed to a vertical state.

14. The hinge used for the collapsible container according to claim 13, wherein the inner hinge plates are L-shaped plates, and the two pivoting holes located on the inner hinge plates are formed on two extended ends of the inner hinge plate respectively; the outer hinge plates are L-shaped plates, and the two pivoting holes located on the outer hinge plates are formed on two extended ends of the outer hinge plate respectively.

15. The hinge used for the collapsible container according to claim 13, wherein an inner hinge top plate with a U-shaped notch are provided on top of the inner hinge plates parallel to each other, and is perpendicular to the inner hinge plates.

16. The hinge used for the collapsible container according to claim 15, wherein the inner hinge is a casting or a welded part integrally formed by the two inner hinge plates and the inner hinge top plate.

17. The hinge used for the collapsible container according to claim 13, wherein an outer hinge top plate perpendicular to the outer hinge plates is provided on top of the two outer hinge plates parallel to each other, and protrusions being fittingly connected with the corner post of the end wall are provided on top ends of the two outer hinge plates connected to the corner post of the end wall of the collapsible container.

18. The hinge used for the collapsible container according to claim 17, wherein the outer hinge is a casting or a welded part integrally formed by the two outer hinge plates and the outer hinge top plate.

* * * * *